United States Patent [19]

Kohlmetz et al.

[11] Patent Number: 4,696,283

[45] Date of Patent: Sep. 29, 1987

[54] KINETIC HEATER

[76] Inventors: Charles W. Kohlmetz, 27 Brook Hill La., Rochester, N.Y. 14625; James J. Urban; John Kenny, both of Main St., Dunstable, Mass. 01827

[21] Appl. No.: 836,693

[22] Filed: Mar. 6, 1986

[51] Int. Cl.[4] ..... F24C 9/00

[52] U.S. Cl. ..... 126/247

[58] Field of Search ..... 126/247; 122/26; 237/12.1; 290/2

[56] References Cited

U.S. PATENT DOCUMENTS

| | | | |
|---|---|---|---|
| 1,228,215 | 5/1917 | Junkers | 122/26 |
| 1,682,102 | 8/1928 | Allen . | |
| 3,245,399 | 4/1966 | Lawson . | |
| 3,253,649 | 5/1966 | Laing . | |
| 3,273,631 | 9/1966 | Neuman | 122/26 X |
| 3,297,019 | 1/1967 | Lawson . | |
| 3,385,287 | 5/1968 | Lawson et al. . | |
| 3,481,322 | 12/1969 | Hokanson, Sr. et al. . | |
| 4,285,329 | 8/1981 | Moline | 126/247 |
| 4,462,386 | 7/1984 | Powell | 126/247 |
| 4,480,592 | 11/1984 | Gokcen | 126/247 X |
| 4,499,913 | 2/1985 | Frenette | 126/247 |

FOREIGN PATENT DOCUMENTS

| | | | |
|---|---|---|---|
| 371529 | 3/1923 | Fed. Rep. of Germany | 122/26 |
| 2125532 | 3/1984 | United Kingdom | 126/247 |
| 2143632 | 2/1985 | United Kingdom | 126/247 |

*Primary Examiner*—Randall L. Green

*Attorney, Agent, or Firm*—Stonebraker, Shepard & Stephens

[57] ABSTRACT

A rotor 20 having several impellers 21 interleaved with a multi-stage stator 30 pumps ambient air through each stage in a path that flows radially outward through impeller vanes 27 against a stator wall 32 where the air is retroverted and directed radially inward through a stator passageway 36 to the next rotor impeller 21. Flow through each stage increases air temperature so that the output air, in addition to being blown forcibly enough to pass through ductwork, is warmed enough to afford space heating.

18 Claims, 6 Drawing Figures

KINETIC HEATER

BACKGROUND

Several air heaters have exploited the fact that air is warmed as it flows turbulently through the blades of a blower or pump. The temperature increase in a single pass of the air through blower blades is usually tiny, however, so that practically useful increases in air temperature have required that the air pass many times through the blower blades. Although this gradually heats the air, it greatly diminishes the ability of the blower to move the air elsewhere.

We have found a way of heating air effectively in a multi-stage blower that can also pump air at a flow rate adequate to serve as a space heater. Each stage of our heater is especially effective in heating air and can achieve at least a 10° temperature rise—to require only a few stages for a practically usable temperature increase. Since the air passes only once through each stage, our heater is also effective as a through-flow pump that can distribute heated air through ducts in a building. Our heater heats return air without changing moisture content or causing any odor; and since it has no high temperature region, it is safe and practical in explosive or flammable environments.

SUMMARY OF THE INVENTION

Our air heater and pump uses a multi-stage rotor and stator in which a series of rotor impellers are interleaved with series of stator passageways. Through-flowing air, pumped radially outward by each rotor impeller, is directed against a stator wall and then retroverted back on a radially inward path. Each stator stage, besides retroverting the discharge air from each rotor impeller, provides a radially walled passageway for guiding inflowing air back to an inlet of the next rotor impeller. The air thus flows in a zigzag path radially outward and inward, increasing the air temperature at each stage, as the air is pumped through the heater. Our invention includes the way the stator stages are stacked and structured relative to rotor impellers and the way these are spaced and interleaved with stator stages. Our heater's objectives include simplicity, economy, safety, efficiency, and capability of serving both as an air-pumping blower and as a heater that can increase the temperature of the through-flowing air by several tens of degrees.

DRAWINGS

DETAILED DESCRIPTION

Figure 1:
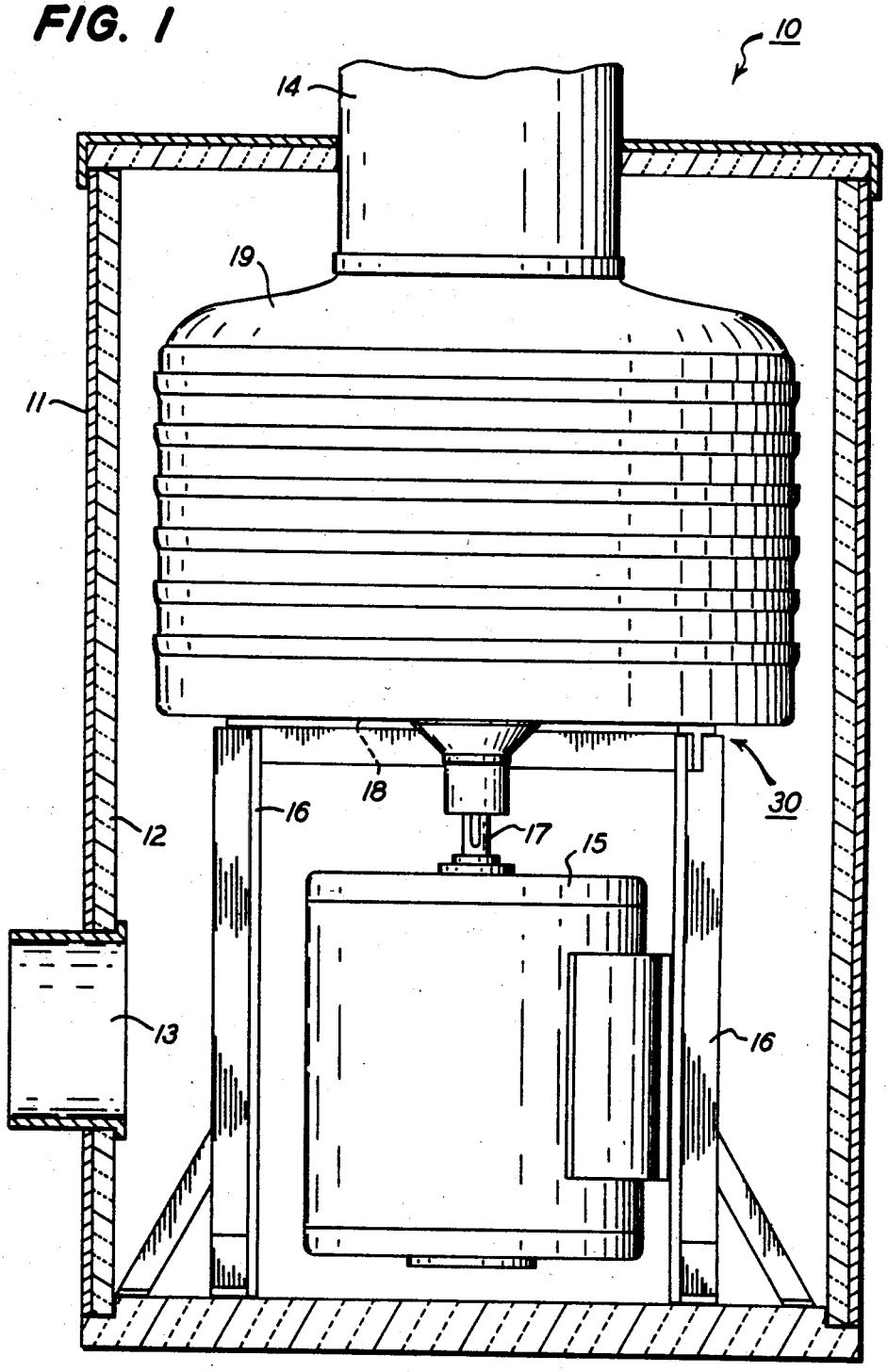
FIG. 1 is a partially cross-sectioned, partically schematic, elevational view of a preferred embodiment of our heater.
Figure 2:
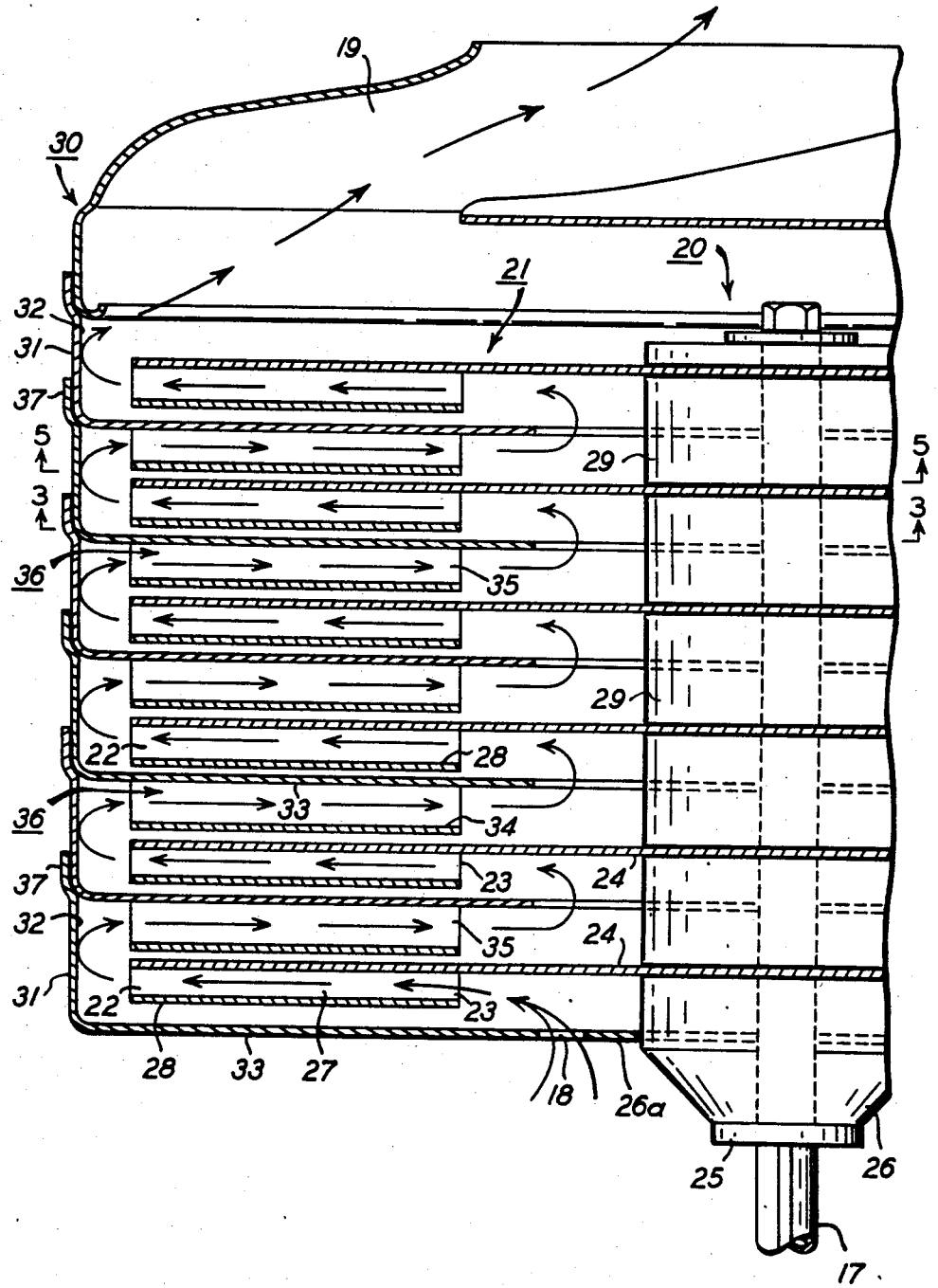
FIG. 2 is a fragmentary and partially cross-sectioned view of preferred rotor and stator stages for the heater of FIG. 1.
Figure 5:
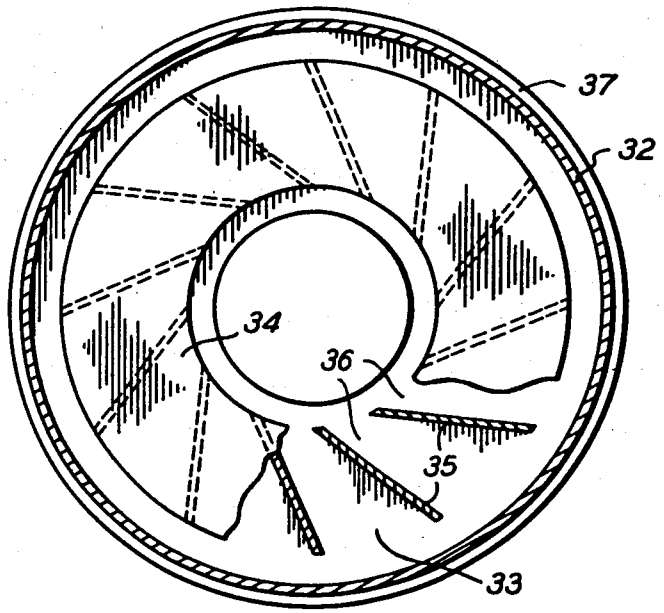
FIG. 5 is a partially cutaway view of a stator used in FIGS. 1 and 2 and taken along the line 5—5 of FIG. 2.
Figure 3:
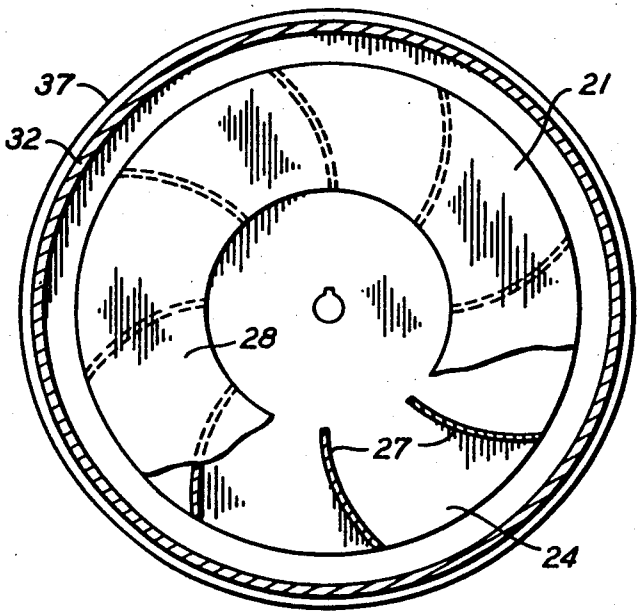
FIG. 3 is a partially cutaway view of a rotor impeller used in the heater of FIGS. 1 and 2 and taken along the line 3—3 of FIG. 2.
Figure 6:
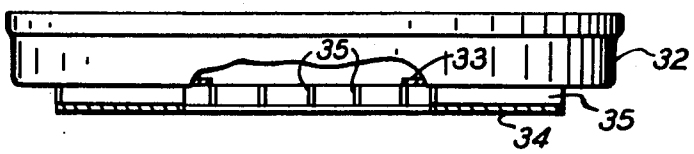
FIG. 6 is a partially cutaway side elevational view of the stator of FIG. 5.
Figure 4:
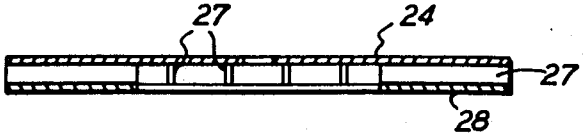
FIG. 4 is a diagonal cross-sectional view of the rotor impeller of FIG. 3.

Heater 10, as shown in FIGS. 1 and 2, includes a motor 15 turning a rotor 20 within a stator 30 arranged in a box 11 that is preferably lined with insulation 12 to reduce noise and heat loss. An air inlet 13 admits ambient or return air into box 11, and an outlet duct 14 directs the heated, outflowing air—usually to conventional ductwork. A stand 16 supports stator 30 and motor 15 in the path of inflowing air that keeps motor 15 cool and slightly warms the air as it proceeds to intake 18 around shaft 17 in the initial stator stage 31.

Inside of stator stage 31, as shown in FIG. 2, inflowing air encounters the first rotor impeller 21, which pumps the air radially outward. Impeller 21 drives the air at a high velocity from peripheral discharge 22 against wall 32 of stator stage 31, where the air is retroverted radially inward. The considerable turbulent energy involved in forcing air at a high velocity against stator wall 32 and turning the air back for a radially inward flow raises the air temperature at least several degrees.

The radially inward flow of the air toward the inlet of the next impeller 21 occurs through passageways 36 between a pair of axially spaced and radially extending stator walls 33 and 34, connected by generally radial vanes 35. These radial passageways 36 through each stator stage 31 lead from the peripheral discharge region 22 of each rotor impeller 21, radially inward to an inlet 23 of a succeeding impeller 21. Stator passageways 36 separate inward-flowing air from the rapidly rotating surfaces of impellers 21, which tend to pump air radially outward. The alternating outward and inward flow of air through each rotor and stator stage repeats as the air passes from inlet 18 to outlet 19. We have found that each stage can increase air temperature by at least 10° so that the six stages shown in FIG. 2 can increase return air temperature by 60° to 80° in a single pass through heater 10.

We prefer that each rotor impeller 21 and each stator stage 31 be identical, except for stator inlet 18 and outlet 19. We also prefer that stator stages 31 be stacked together as shown in FIG. 2 for interleaving stator passageways 36 with rotor impellers 21. This allows identical rotor and stator stages to be manufactured economically and stacked together as illustrated for each heater 10. Lack of any high temperature hot spot within the heater allows resin material to be used in its working parts, so that both impellers 21 and stator stages 31 can be injection molded or resin material for low cost fabrication and quiet operation.

Air inflow through inlet 18 into the first stator stage 31 can be controlled in various ways, and a simple expedient shown in FIG. 2 is to arrange an air inlet control flange **26*a* around a lower spacer 26 on shaft 17 to determine the size of the air opening through inlet 18 into the first stator stage 31**. Other arrangements, such as aperture plates and cowled inlets, are also possible.

We prefer that each rotor 21 be formed of a disk 24 keyed to shaft 17 on which a collar 25 supports a lower spacer 26 and a series of upper spacers 29 positioning each rotor disk 24 axially on shaft 17. Rotor vanes 27 extend generally radially outward between disk 24 and an annular plate 28. There are many other ways that air-pumping vanes 27 can be arranged on an impeller disk 24, and annular plate 28 may not be necessary. Most of the air-pumping work is done by the outer regions of the vanes 27, and these are what drive the pumped air rapidly outward against stator wall 32.

Stator stages 31 nest and stack together, as shown in FIG. 2, by providing each stage 31 with a peripheral wall 37 having a diameter large enough to receive the smaller diameter wall 32 of a stacked stator stage 31. Each stator stage 31 also includes a barrier wall 33 extending radially inward from peripheral wall 32 to at least the inlet region 23 of each rotor impeller 21. Annular wall 34 on the opposite side of stator passageway 36 is spaced radially inward from peripheral wall 32 to admit retroverted air into passageway 36.

Air discharged from the final rotor impeller 21 impinges on wall 32 of the final stator stage 31 and from there is guided through a preferably convolute outlet 19 leading to output duct 14. Outlet 19 can also be tangential or have other suitable shapes.

Experience with different models of our kinetic heater has shown that the size and shape of the inlet and outlet openings affect performance, both in temperature rise and pounds per minute of air throughput. Constricting inflow or outflow tends to increase the temperature rise and decrease the through-flow rate, and opening up the inlet or outlet has the opposite effect. We prefer that outlet 19 be kept open and efficient for effectively delivering heated air, and we prefer adjusting inlet opening 18 to control the air inlet rate for different circumstances, depending on the need for temperature rise or through-flow rate.

Performance of our heater can also be varied by changing the number of rotor and stator stages; changing the diameters of the rotor impellers; changing the shape, number, or axial extent of the vanes 27 on the rotor impellers; and changing the axial width of stator passageways 36, which we prefer to keep adequately wide. Different dimensions of rotor impellers can be mixed in a single heater to adjust temperature rise or air through-flow rate. The rotor can also be powered by different sizes of motors or even by different prime movers turning at different speeds to vary performance. Guiding principles are that the energy input is divided between temperature rise and air through-flow rate, opening or easing the air flow path increases the flow rate and reduces the temperature rise, and constricting or impeding the air flow path increases the temperature rise.

A space heater according to our invention, using a five horse motor 15 turning at 3400 rpm, maintains a through-flow rate in a range of 10 to 14 pounds per minute with a temperature increase from inlet to outlet of 60° to 80° F. This heater can operate continuously without overheating motor 15 and can produce 12,000 BTU per hour at a thermal efficiency of about 95%. We have attained the same temperature increase and thermal efficiency with a three horse power model producing a smaller flow rate; and of course, larger and smaller models are also possible. Box 11 keeps our noise level reasonably low; and our heater has the advantages of no change in moisture content of the air being heated, no odor production, and lack of any high temperature hot spot.

We claim:

1. An air heater and pump comprising:

a. a rotor having a plurality of vaned impellers for pumping air radially outward, said impellers being axially spaced in series and providing the sole motivating force for pumping air through said heater;

b. a stator having multi-stages interleaved with and out of contact with said rotor impellers, each of said stator stages having a radially walled passageway substantially filling the usable space between said rotor impellers without contacting said rotor impellers for guiding inbound air radially inward to an impeller inlet region; and c. each of said stator stages having an outer rim extending axially of said heater from said stator passageway to engage an outer rim of an adjacent stator stage, for spacing said stator passageways clear of said impellers, each of said stator passageways extending inward from said outer rim and having an entrance spaced from said outer rim, and each of said outer rims forming an impingement surface radially surrounding one of said rotor impellers so that outwardly pumped air discharged from the surrrounded impeller against said impingement surface retroverts directly into an inbound course through one of said stator passageways so that each retroverted pass through a stage of said rotor and stator increases the temperature of air being pumped through said heater.

2. The air heater and pump of claim 1 wherein each of said stator passageways includes a pair of axially spaced, radial plates extending from the region of said impingement surface inward to said impeller inlet region.

3. The air heater and pump of claim 2 wherein a plurality of radial vanes interconnect each pair of said stator plates.

4. The air heater and pump of claim 1 wherein said rotor impellers are formed as radial disks secured to a rotor shaft, annular plates axially spaced from said disks, and pumping vanes arranged between said disks and said plates for pumping air radially outward at the periphery of said disks and said plates.

5. The air heater and pump of claim 1 wherein the radial walls of each of said stator passageways comprise an air barrier plate extending radially inward from said rim and an annular plate spaced radially inward from said rim and axially spaced parallel with said barrier plate.

6. The air heater and pump of claim 6 wherein a plurality of radial vanes interconnect each pair of said stator plates.

7. The air heater and pump of claim 1 including an insulated box arranged around and spaced from said stator, an inlet duct for admitting ambient air into said box, and an output duct for guiding heated air from said heater out through said box.

8. A kinetic air heater having a rotor and stator and comprising:

a. said rotor having a plurality of serially staged air-pumping impellers that force air radially outward;

b. said stator having a serially staged plurality of air-guiding passageways interleaved with and out of contact with said rotor impellers;

c. each of said stator passageways being arranged adjacent a peripheral rim of said stator extending axially of said heater to engage a peripheral rim of an adjacent stator stage to space said stator passageways from said impellers, each of said peripheral rims surrounding one of said rotor impellers, and said stator passageways substantially filling the usable space between said rotor impellers without contacting said rotor impellers;

d. each of said stator passageways having axially spaced, radial plates between which pumped air flows radially inward, one of said radial plates being an air barrier plate extending radially inward from said peripheral rim and the other of said radial plates being an annular plate spaced axially from said barrier plate and spaced radially inward from said peripheral rim; and e. said rotor impellers and said stator passageways being arranged with radially spaced-apart inlets and outlets so that air flows radially outward through each rotor impeller against one of said peripheral rims and then retroverts and flows radially inward through each stator passageway, causing through-flowing air to be heated at each retroversion as it is pumped by said impellers.

9. The air heater of claim 8 including an annular inlet opening in said barrier plate of an initial stage of said stator to size an air entrance to the first of said rotor impellers.

10. The air heater of claim 8 including an insulated box arranged around and spaced from said stator, an inlet duct for admitting ambient air into said box, and an output duct for guiding air from said heater out through said box.

11. The air heater of claim 8 including a plurality of radial vanes arranged in each of said stator passageways between said radial plates.

12. A method of heating air as it is pumped, said method comprising:

a. pumping air radially outward through each impeller of a multi-impeller rotor;

b. using stacked together outer rims of a multi-stage stator for spacing stator stages clear of said impellers and so that the outer rim of each stator stage extends axially of said heater to surround one of said impellers for retroverting discharge air from said impellers to flow radially inward between said impellers; and c. at each stator stage guiding inward flowing air through a walled stator stage passageway substantially filling the usable space between said impellers without contacting said impellers and extending from said stator rim adjacent the retroverted discharge of each impeller to a radially inward inlet region of a succeeding impeller so that the pumping turbulence and retroversions of the air increase its temperature as it is pumped through said rotors and said stator stages.

13. A multi-stage kinetic air heater having in each stage a rotor and stator comprising:

a. each of said rotor impellers having an inlet and outlet spaced radially apart;

b. each of said stator stages having an outer rim extending axially of said heater to surround one of said impellers in the path of air discharged from said outlet;

c. each of said stator stages having a stator passageway extending radially inward from said outer rim and having an entrance spaced from said outer rim, said stator passageway being formed with axially spaced, radial walls arranged axially adjacent a region where said outer rim surrounds one of said impellers, and said stator passageway being sized for occupying substantially all the usable space between successive rotor impellers without contacting said rotor impellers so that air having its temperature increased by being pumped radially outward by said impellers against said outer rims around said impellers can flow radially inward through said stator passageways to an inlet of a succeeding rotor and stator stage; and d. said outer rim of each of said stator stages being stacked against an outer rim of an adjacent stator stage for spacing said passageways clear of said impellers.

14. The air heater of claim 13 wherein said stator passageway is formed as a barrier plate extending inward from said rim and an annular plate axially spaced from said barrier plate and radially spaced from said rim.

15. The air heater of claim 13 including radial vanes interconnecting said walls of said stator passageway.

16. A multi-stage kinetic air heater having stator stages interleaved between impeller stages and comprising:

a. an outer rim of each of said stator stages having larger and smaller diameter regions arranged so that said smaller diameter region fits within said larger diameter region of said outer rim of an adjacent stator stage for stacking said stator stages;

b. an air barrier plate extending radially inward from said outer rim;

c. an annular plate axially spaced from, and parallel with, said barrier plate and extending radially inward from a region spaced from said outer rim; and d. said plates of successive ones of said stator stages being axially spaced apart to provide working clearance with an interleaved impeller stage substantially filling the usable space between said stator stages without contacting said stator stages.

17. The air heater of claim 16 wherein said stator stages are molded of resin material.

18. The air heater of claim 16 including radial vanes interconnecting said plates within each of said stator stages.

* * * * *